US012234602B2

(12) United States Patent
Salaroli et al.

(10) Patent No.: US 12,234,602 B2
(45) Date of Patent: Feb. 25, 2025

(54) APPARATUSES, METHODS AND SYSTEMS FOR YIELD INCREASE IN A KRAFT COOKING PLANT

(71) Applicant: Bracell Bahia Specialty Cellulose SA, Bahia (BR)

(72) Inventors: Vinicius de Oliveira Salaroli, Bahia (BR); Nils Daniel Trolin, Bahia (BR)

(73) Assignee: Bracell Bahia Specialty Cellulose SA, Camaçari (BR)

( * ) Notice: Subject to any disclaimer, the term of this patent is extended or adjusted under 35 U.S.C. 154(b) by 0 days.

(21) Appl. No.: 17/746,826

(22) Filed: May 17, 2022

(65) Prior Publication Data

US 2023/0374730 A1 Nov. 23, 2023

(51) Int. Cl.

| | |
|---|---|
| ***D21C 1/04*** | (2006.01) |
| ***D21C 1/02*** | (2006.01) |
| ***D21C 3/02*** | (2006.01) |
| ***D21C 7/06*** | (2006.01) |

(52) U.S. Cl.
CPC ..... *D21C 1/04* (2013.01); *D21C 1/02* (2013.01); *D21C 3/022* (2013.01); *D21C 7/06* (2013.01)

(58) Field of Classification Search
CPC ..... D21C 1/02; D21C 1/04; D21C 3/022
See application file for complete search history.

(56) References Cited

U.S. PATENT DOCUMENTS

| | | | | |
|---|---|---|---|---|
| 4,668,340 | A * | 5/1987 | Sherman | D21C 1/04 162/39 |
| 6,468,390 | B1 * | 10/2002 | Snekkenes | D21C 3/22 162/37 |
| 8,951,388 | B2 * | 2/2015 | van Lee | D21C 7/06 162/18 |
| 10,023,995 | B2 * | 7/2018 | Bogren | D21C 9/02 |
| 2004/0089431 | A1 * | 5/2004 | Fant | D21C 1/06 162/29 |
| 2011/0192560 | A1 | 8/2011 | Hiekkila et al. | |
| 2015/0136346 | A1 | 5/2015 | Bogren et al. | |
| 2019/0390404 | A1 * | 12/2019 | Parkås | D21C 9/02 |

FOREIGN PATENT DOCUMENTS

| | | | | |
|---|---|---|---|---|
| WO | WO-2013178608 | A1 * | 12/2013 | C08B 9/00 |
| WO | WO-2017142445 | A1 * | 8/2017 | D21C 1/02 |

OTHER PUBLICATIONS

Rydholm, Pulping Processes, 1965, Interscience Publishers, p. 662-667. (Year: 1965).*
H. Sixta, Handbook of Pulp, 1348 pgs (2006).
G. Garrote, et al., Hydrothermal Processing of Lignocellulosic Materials, Holz als roh-und werkstoff 57 (3), 191-202 (1999).

* cited by examiner

*Primary Examiner* — Anthony Calandra
(74) *Attorney, Agent, or Firm* — Irell & Manella LLP

(57) ABSTRACT

The present synergies for at least two parallel cooking plants, e.g., one producing dissolving pulp in a prehydrolysis kraft process, and the other producing kraft pulp by kraft pulping process, which may facilitate increased cooking yield in the kraft cooking plant producing kraft pulp by recovering the hemicelluloses solubilized in the acidic hydrolysate of the prehydrolysis kraft process. In some implementations, there may be no cold caustic extraction step on the dissolving pulp line as the target pulp purity can be achieved by performing just a prehydrolysis step, with reutilization of an acidic hydrolysate stream in a kraft pulp line.

21 Claims, 5 Drawing Sheets

APPARATUSES, METHODS AND SYSTEMS FOR YIELD INCREASE IN A KRAFT COOKING PLANT

This application for letters patent disclosure document describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

FIELD

This innovation refers to pulp production and more specifically increasing pulp yield in a kraft cooking process.

BACKGROUND

Biomass utilization as feedstock for various industries and products has increased in recent years. In this context, the pulp and paper industry provides materials with low carbon footprint, including dissolving pulp, which can supply a large number of industries such as regenerated cellulose (e.g. viscose and lyocell fibers, cellophanes and sponges), cellulose acetates, cellulose nitrates and several others.

Wood and other materials used in the pulp and paper industry are formed by four main chemical components—cellulose, hemicellulose, lignin and extractives. Compared to paper-grade pulp, dissolving pulp can be characterized by a higher purity, e.g., a higher cellulose content and lower hemicellulose content. While in the former the challenge is to remove most of the lignin and extractives in the cooking and bleaching reactions, while also preserving most of the cellulose and hemicelluloses, in dissolving pulp the challenge is to also remove the hemicelluloses resulting in a product that is at least 90% pure in alpha-cellulose.

Wood, either softwood or hardwoods, is the primary raw material used in pulp industry. While the macromolecular composition is similar among all species, the rations between the components can vary, such as shown in table 1 (Sixta, 2006).

TABLE 1

| | Composition (%) | |
|---|---|---|
| | Hardwood | Softwood |
| Cellulose | 43-47 | 40-44 |
| Hemicellulose | 25-35 | 25-29 |
| Lignin | 16-24 | 25-31 |
| Extractives | 2-8 | 1-5 |

Wood cost impacts cost in pulp production, and consequently pulp yield is a substantial economical factor and area of development and research. As a result of removing most of wood constituents except cellulose, a dissolving pulp process may have a yield in the range of 35 to 38%, which is lower than a paper-grade making process, which yield generally exceeds 50%.

The kraft process (KP) and the prehydrolysis kraft cooking (PHK) process or prehydrolysis sulfate cooking has been described in literature, as in Sixta, H., Handbook of pulp, and also is employed for producing paper-grade pulp and dissolving pulp, respectively, from lignocellulosic materials.

A prehydrolysis step applied before a kraft cooking process can selectively break and solubilize short-chain molecules such as hemicelluloses, producing an acid carbohydrate-rich aqueous phase. The prehydrolysis severity is controlled with the so-called P-factor, which is a single parameter combining both reaction temperature and retention time in the prehydrolysis stage and is manipulated to control pulp purity. Pulp purity may be determined, e.g., by alpha cellulose test (Tappi T-203) or alkali solubility methods (Tappi T-235) or similar from other standards.

During prehydrolysis, acetyl groups are released into aqueous phase as a result of cleavage reactions of hemicellulose molecule chains (mainly (Glucurono)xylan in hardwood and (Galacto)glucomannan in softwood), reducing the pH generally to the range of 3-4. Also with addition of catalysts such a mineral acid, pH can be further reduced below 2.0 to increase reaction rates. It has been reported, by Garrote (1999), that up to 95% of the original hemicellulose content present in the wood source can be removed during prehydrolysis, while there is little effect on lignin and cellulose molecules. Hemicelluloses removed from the wood source will be present in the aqueous solution in the form of oligomers, monomers or converted to byproducts such as furfural or acetic acid. The resulting acidic liquid containing the dissolved hemicelluloses may be referred to as hydrolysate or acidic hydrolysate.

To terminate the prehydrolysis reactions, chips are alkalinized at a lower temperature than during the prehydrolysis phase in a step referred to as neutralization, raising pH above 11 by the addition of a strong alkaline solution such as white liquor, black liquor or other alkali rich filtrates, e.g. filtrate from a subsequent cold caustic extraction (CCE) stage.

Several implementations of the PHK process have been discussed, more extensively in batch digesters and its variations such as Continuous Batch Cooking and Superbatch processes.

In batch systems, for every cooking cycle the batch digester is filled by dropping the wood chips through an opening at the vessel top. The wood chips may be carried into the digesters by screw and/or belt conveyors and pass through a packing device as they enter the digester to aid increasing the amount of wood charged per batch. A packing device may include a set of low pressure steam nozzles to push and distribute the chip flow downwards. Water vapor displaces the air from the voids both inside and outside the chips and gas is continuously vented from the digester.

When the digester is completely filled, the top opening is closed and more steam is injected inside the vessel to heat the chips to the target prehydrolysis temperature, e.g., higher than 150° C. When the target temperature is reached, steam valves are closed and the digester is kept for a time period until the target P-factor is reached.

In batch systems the prehydrolysis step is carried out in a "steam phase" as wood chips and steam are fed to the digester until the completion of the prehydrolysis. The liquid media is inside the vessel at this phase is a mixture of wood moisture and steam condensate, located mostly inside the chip voids and there is a negligible amount of free liquor between the chips. After the prehydrolysis reactions, with the formation of acetic acid and solubilization of hemicelluloses in the liquid phase, the total liquid volume may not exceed 1 cubic meter per bone dry metric ton of wood ($m^3$/BDtw).

Following the prehydrolysis, the neutralization step is performed by injecting a strong alkaline solution in the digester bottom and the neutralization liquor will be displaced through the digester as more liquor is added. As the neutralization liquor impregnates the wood chips, it will simultaneously displace and mix with the acid hydrolysate formed in the voids inside the chips. Thus, a PHK batch system produces virtually no acid stream that can be separated and reused for other purposes.

PHK cooking process may also include implementations comprising continuous cooking systems, and more specifically, systems where the prehydrolysis step is conducted in a separate vessel than the alkaline cooking phase.

In such systems, lignocellulosic material such as wood chips and water/condensate are continuously fed to the top of a vessel, e.g., a prehydrolysis vessel or PHV, capable of retaining its contents for the required time and temperature to reach a desired prehydrolysis reaction severity.

The prehydrolysis step may be initially performed in steam phase, e.g., at the top of the PHV while the biomass is heated by direct steam injection, but the majority of the prehydrolysis reactions occur in aqueous phase in a manner that the amount of water present inside the vessel relative to the amount of chips is generally in the range of 2 to 5 $m^3$/BDTw. This volume of water is significantly higher compared, e.g., to batch digesters, in which it is generally not higher than 1 $m^3$/BDTw as the majority of water inside the digester in this phase is only due to wood moisture and condensate generated by direct steam heating.

Neutralization is typically done either inside the PHV (at the lowest zone/bottom part of the vessel) or at the top of the subsequent digester or even in the pipe transferring the chips from the prehydrolysis vessel to the digester.

A part of the free acidic hydrolysate may be extracted from the PHV vessel through one or more screen (strainer) sections before the neutralization phase is initiated. There are several purposes for this early extraction, such as removing the dissolved hemicelluloses from the process for improved pulp purity or side-production of hemicellulose derivative products like Xylitol or furfural. The extracted acidic hydrolysate may be neutralized with white liquor, mixed with spent cooking liquor and then sent to a heat recovery system (flash tanks or heat exchangers), and then further off to the recovery island, were the hemicelluloses together with other organic compounds are burnt in the recovery boiler for steam generation.

The amount of available hydrolysate for extraction depends on several factors such as chip moisture, water intake with chips, steam condensate generation during direct steam heating at PHV vessel top, PHV degassing, prehydrolysis severity factor, prehydrolysis yield and whether PHV bottom displacement washing takes place or not.

Remaining free and bound hydrolysate fraction inside the PHV is neutralized together with the chips and is carried to the digester via transfer circulation line.

From the bottom of the PHV, chips are transferred to the top of the cooking vessel, e.g., the digester to perform the alkaline kraft cooking process. There are various digester configurations, differing from each other by, e.g., the number of circulation zones, liquor addition, extraction points, number/position of strainers and whether digester is of hydraulic or steam liquor phase type.

Some mills have undergone expansion projects and currently have more than one cooking on same mill site. Moreover, many of those existing installations have been converted from paper grade pulp to dissolving pulp mills, either permanently or on a flexible/swing basis.

Adjacent parallel lines simultaneously producing paper grade and dissolving pulp allow for integration of both lines. Side streams, such as extracted liquors from one digester, may be used in strategic positions in the other line in order to improve pulping yield and/or quality. As exemplification, a system using such integration was disclosed by BOGREN et al (WO/2013/178608). There, a cold caustic extraction filtrate (CCE filtrate) containing high molecular weight xylan is extracted from a prehydrolysis kraft pulp line producing dissolving pulp and sent to a parallel kraft pulp line producing conventional kraft pulp in order to increase kraft pulp yield, improve process economy and mechanical properties of the final kraft pulp. Said CCE filtrate is added after the completion of the alkaline impregnation of the wood material so that it will become residual cooking liquor.

SUMMARY

The APPARATUSES, METHODS AND SYSTEMS FOR YIELD INCREASE IN A KRAFT COOKING PLANT disclosed herein in various embodiments present synergies for at least two parallel cooking plants, e.g., one producing dissolving pulp in a prehydrolysis kraft process, and the other producing kraft pulp by kraft pulping process. Some embodiments may act to increase cooking yield in the kraft cooking plant producing kraft pulp by recovering the hemicelluloses solubilized in the acidic hydrolysate. In some embodiments, the extracted hydrolysate stream, that may otherwise would be disposed to the recovery island for steam generation and/or used to produce side-products, is reutilized in the adjacent kraft pulp line for production of kraft pulp. In embodiments of the disclosed apparatuses, methods and systems, there may be no cold caustic extraction step on the dissolving pulp line as the target pulp purity can be achieved by performing just a prehydrolysis step, with reutilization of an acidic hydrolysate stream in a kraft pulp line.

Under some conditions, a fraction of the hemicelluloses and other organic compounds dissolved in the acidic hydrolysate will precipitate onto the fibers increasing the cooking yield, thus reducing the overall specific wood consumption and/or increasing the pulp throughput. Embodiments of the disclosed apparatuses, methods and systems may cause the final bleached pulp to also have increased hemicellulose content, providing, e.g., improved beatability, mechanical properties, and/or the like.

Embodiments of the disclosed apparatuses, methods and systems may include two methods for reutilizing the acidic hydrolysate in a kraft cooking process for kraft pulp.

One method (A) comprises a pretreatment step where wood chips are carried into an acidic impregnation phase prior to the alkaline cooking process. Steamed chips are mixed with cooled acidic hydrolysate extracted from the adjacent PHK line so that chips are soaked and saturated with hydrolysate and dissolved hemicelluloses will precipitate onto the fibers. The acidic hydrolysate is cooled to such extent that the resulting chip and hydrolysate mixture temperature becomes 70° C.-125° C., or 100° C. After this step any kraft cooking process can be performed to produce pulp, such as conventional cooking or other modified cooking methods such as ITC cooking, Lo-Solids process, Compact Cooking process, Superbatch cooking, and/or the like.

The acidic impregnation phase in a continuous digester may be performed with or without providing a significant retention time. In other terms, chips can be sent directly to the digester using only the chip feeding system as impregnation phase with short retention time (≤5 min), or alternatively using the digester top part to provide extended retention time, or still another arrangement is to use a separate vessel for the acidic impregnation step.

For batch cooking plants, acidic chip impregnation may be performed in the same digester vessel as the sub-sequent alkaline kraft pulp cooking step (e.g., in-between digester chip filling sequence and kraft cooking phase)

The degree of hemicellulose recovery may depend on several factors in various implementations, such as, but not limited to, wood species and applied process conditions, of which retention time has a significant effect on obtained result. This retention time effect was verified in the laboratory by conducting pilot scale cooks with Eucalyptus Urograndis. Pulp yield with different acidic impregnation times were compared with reference cooks without using the hydrolysate recovery step and at same kappa number level. It was found that the retention time to maximize the hemicellulose recovery was in the range of 40 to 100 minutes, as shown in table A. However, a process with minimal impregnation time (no extra vessel or zone) can be also economically feasible due to the lower implementation cost.

A second method (B) involves, instead of having a dedicated acidic impregnation vessel or zone, injecting the acidic hydrolysate to an alkaline cooking zone inside the digester. Implementations of continuous cooking digesters may comprise of various cooking zones, separated by strainers in the vessel wall where liquor circulations, liquor extractions and injections, changes in temperature and alkali profiles occur.

According to the second method (B), acidic hydrolysate is added to a low alkali concentration cooking zone, such as to last cooking zone, where residual effective alkali is below 10 g EA/l so that, parallel to the cooking reactions, hemicellulose will precipitate onto the fiber surfaces.

For batch digesters and method (B), acidic hydrolysate is introduced at end of cooking circulation and/or during sub-sequent cold displacement phase.

In one embodiment, a process for increasing the pulp yield in a kraft cooking plant is disclosed, comprising: utilizing a stream of acidic hydrolysate from an adjacent prehydrolysis kraft process producing dissolving wood pulp.

In another embodiment, a method for producing kraft pulp is disclosed, comprising: extracting an acidic hydrolysate from a prehydrolysis kraft process producing dissolving wood pulp; applying the acidic hydrolysate to a kraft cooking process in a kraft cooking plant.

In another embodiment, a system for producing kraft pulp is disclosed, comprising: a kraft cooking plant; and an acidic hydrolysate source providing acidic hydrolysate to a kraft cooking process of the kraft cooking plant.

BRIEF DESCRIPTION OF THE DRAWINGS

The accompanying appendices and/or drawings illustrate various non-limiting, example, innovative aspects in accordance with the present descriptions.

Embodiments of the disclosed apparatuses, methods and systems include two parallel continuous cooking plants, one line producing a prehydrolysis kraft dissolving wood pulp (PHK) and the second line producing kraft pulp (KP) by a kraft process (KP). Alternative embodiments include two parallel lines where the dissolving wood pulp is produced in continuous PHK process while the kraft pulp is produced in a batch kraft process. The PHK process may comprise of one or several vessels.

Figure 1:
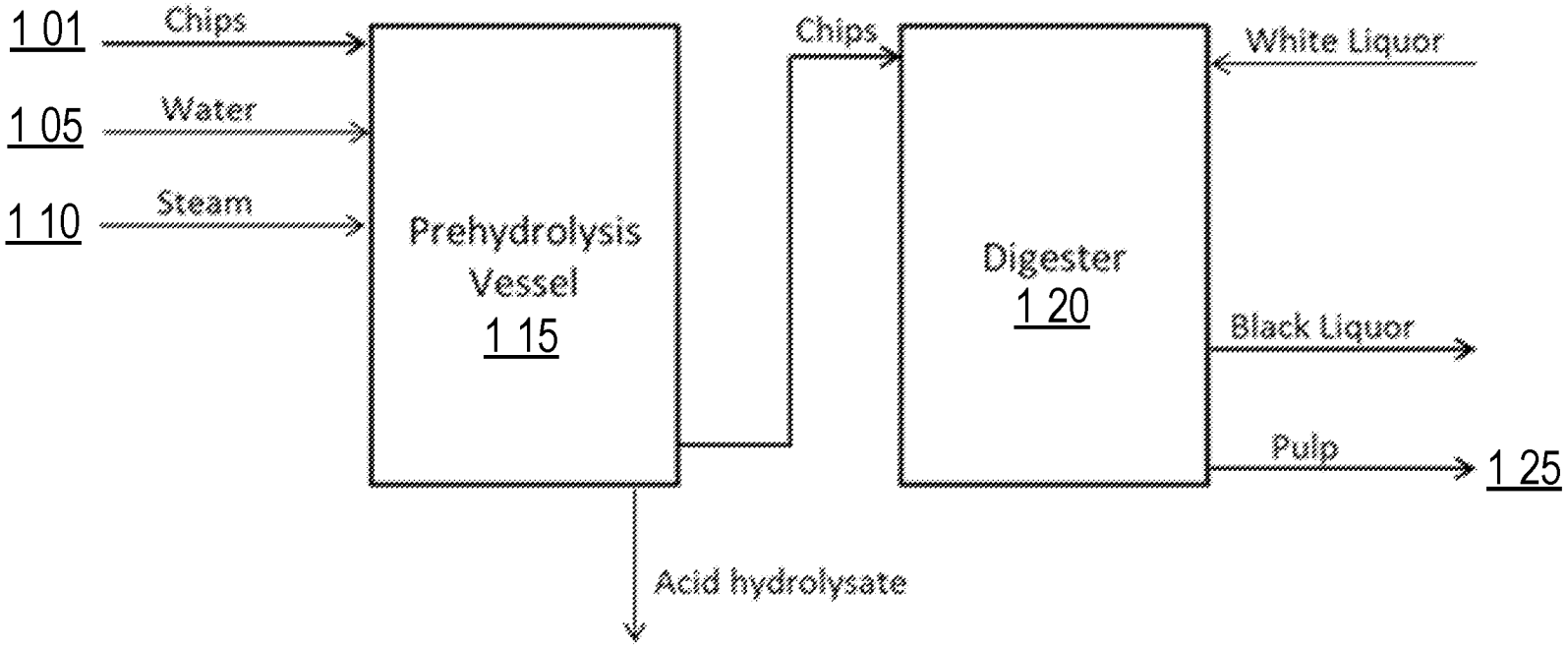
FIG. 1 shows a flowsheet of a PHK cooking plant representing a 2-vessel continuous digester for dissolving grade pulp production, with side stream of acidic hydrolysate generation containing said dissolved hemicelluloses in one embodiment.

FIG. 1 shows a configuration of a Prehydrolysis Kraft (PHK) continuous cooking plant for dissolving grade pulp production in one embodiment. In such embodiment, wood chips 101, water 105 and steam 110 are fed into a vessel where the prehydrolysis reaction is conducted 115. Water and/or evaporation plant clean condensate is added, e.g., in an amount of 0.5 to 5 $m^3$/BDtw, or in the range of 1 to 3 $m^3$/BDtw relative to the wood inlet flow. Prehydrolysis temperature inside the PHV vessel may be controlled by the steam flow to achieve a target prehydrolysis severity (P factor) for a given chip retention time, e.g., in the range of 140 to 175° C. for a P factor in the range 50 to 1000 units.

With the progressive degradation and solubilization of hemicelluloses, the liquid phase of the reactor is transformed into hydrolysate. In the conditions aforementioned, up to 5 $m^3$/BDtw, or up to 2 $m^3$/BDtw, of hydrolysate can be separated from the wood chips stream, e.g., via strainers on the prehydrolysis vessel 115, then sent to the parallel kraft pulp line for recovery. Wood chips are transferred to the second vessel (digester) 120 and cooked to produce dissolving grade pulp 125.

Embodiments of the disclosed apparatuses, methods and systems include implementation of methods A and/or B for reutilizing the hydrolysate in a second parallel production line, which may serve to reduce overall specific wood consumption.

Figure 2:
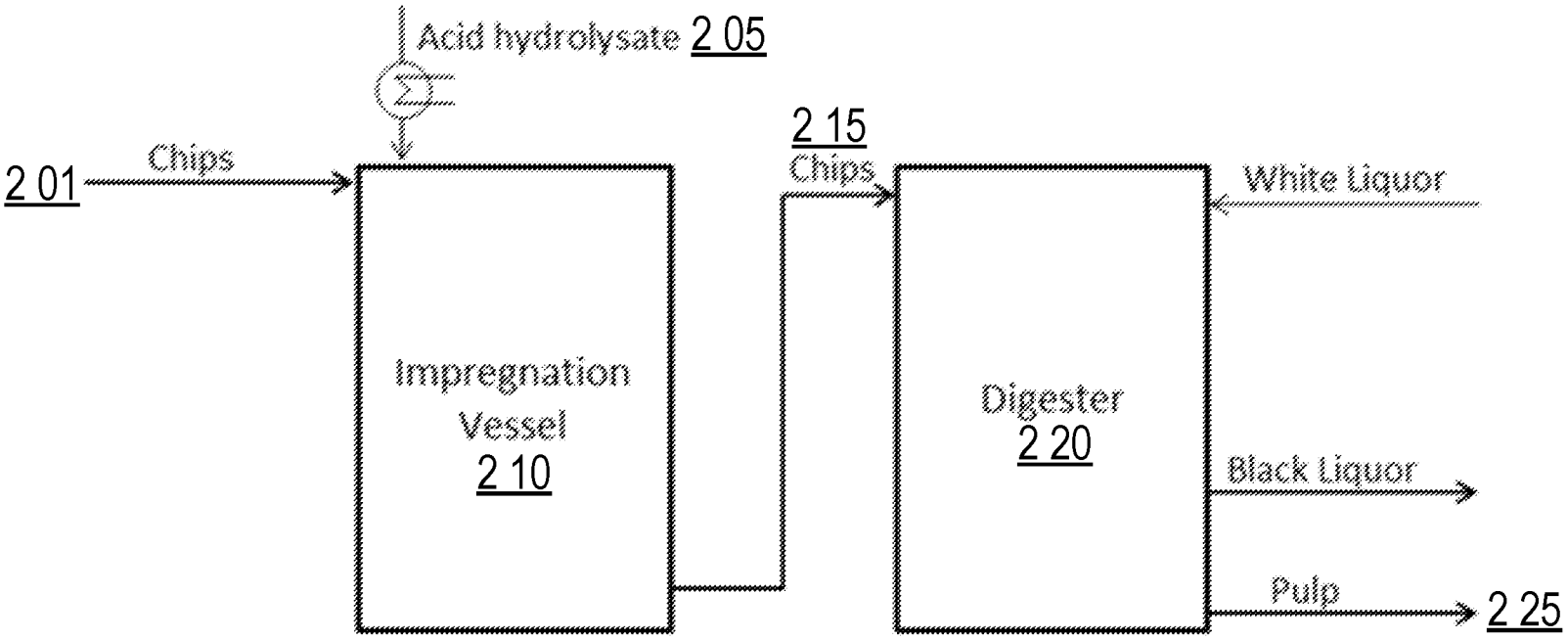
FIG. 2 shows a flowsheet of an embodiment of method A in Kraft cooking plant for kraft pulp, representing a 2-vessel continuous digester configuration with separate acidic chip impregnation vessel.

One embodiment type of method A is represented in FIG. 2. Chips 201 and hydrolysate 205 may be continuously fed into a vessel 210 for an acidic impregnation time up to 180 minutes, or in the range of 40 to 100 minutes at a temperature of 70 to 125° C. In some implementations. hydrolysate may be added in an amount comprising up to 5 $m^3$/BDt of wood, or in the range of 0.5 to 2 $m^3$/BDtw, and may be cooled by flashing and/or in an indirect heat exchanger to reach a target impregnation temperature. From the vessel outlet the hydrolysate impregnated chips 215 are transferred to the sub-sequent digester 220 for continuous kraft cooking to produce wood pulp for paper grade 225.

Figure 3:
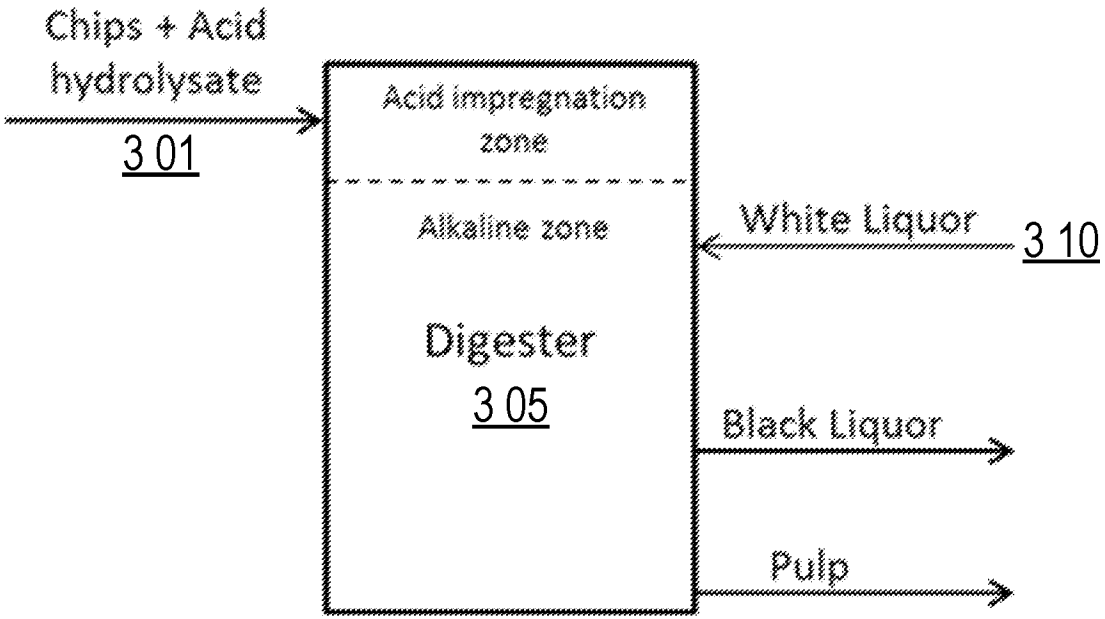
FIG. 3 shows a flowsheet of an embodiment of method A in Kraft cooking plant for grade kraft pulp, representing a 1-vessel configuration (continuous or batch digester)

Another variation of method A is represented in FIG. 3. In this embodiment, chips and hydrolysate 301 are fed to the top of the digester 305 directly, instead of to a separate vessel. In such embodiments, the acid impregnation occurs in the topmost zone of the digester, in the same mass quantities, impregnation time and temperatures as above mentioned. At the designed section to start the alkaline cooking process, excess hydrolysate can be extracted and replaced with white liquor 310 and/or other alkaline liquor to neutralize and alkalinize the acidic chips and remaining hydrolysate. After neutralization, the following digester cooking zones are typical for any kraft cooking processes and will not be described further.

Method A described above can be further derived to embodiments where the KP line comprises a batch cooking system. In such implementations, the hydrolysate can be, e.g.:

Cooled and fed into the digester top simultaneously with the wood chips; or

Injected in the digester bottom after the wood chips are loaded, and further displaced through the digester by injecting liquor, e.g., white liquor and/or other alkaline liquor to neutralize and alkalinize the acidic chips and remaining hydrolysate.

Figure 4:
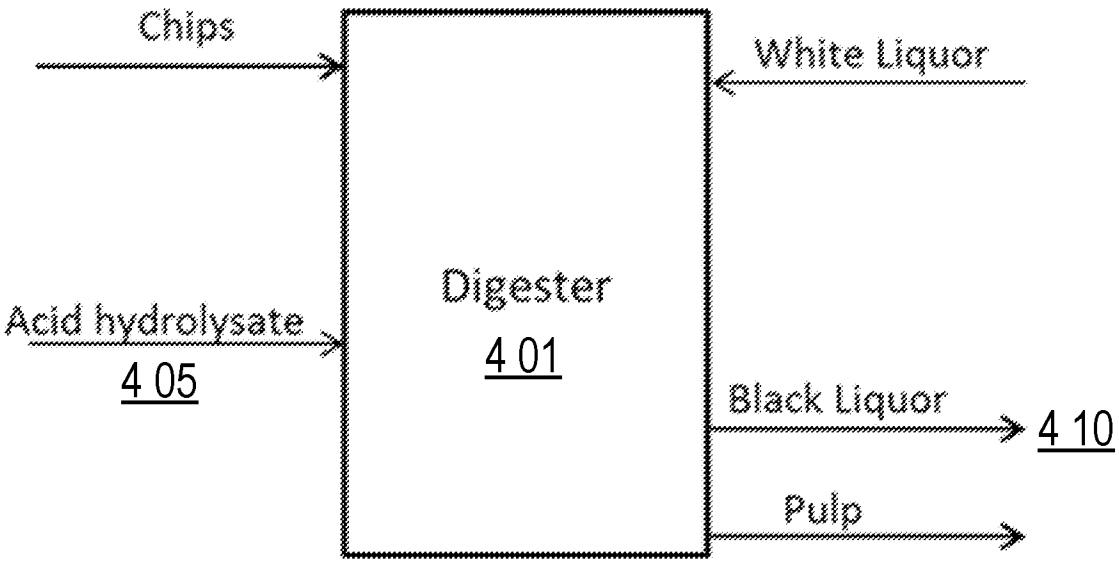
FIG. 4 shows a flowsheet of an embodiment of method B in Kraft cooking plant (continuous or batch digester) for kraft pulp.

FIG. 4 shows an embodiment of method B. In a continuous cooking digester 401, comprising of multiple zones, hydrolysate is added 405, e.g., to the lowest (e.g., final) cooking zone in an amount, e.g., up to 2 $m^3$/bdt relative to the dry wood inlet flow. A matching amount of black liquor 410 can be extracted from the digester so the liquor to wood flow ratio is not adversely affected by the hydrolysate addition. In this implementation, the retention time in the combined precipitation/cooking phase may be, e.g., in the range of 30 to 90 minutes, a residual effective alkali below 10 g/l as NaOH and typical temperatures (140-170° C.) for kraft cooking processes.

In an alternative implementation of method B for batch cooking systems, hydrolysate 405 can be added to the digester 401 in an intermediate time in the cooking phase, e.g., being mixed with the cooking liquor inside the digester and circulated by the remaining cooking duration, displaced through the digester (in systems without a circulation pump), and/or the like.

Figure 5:
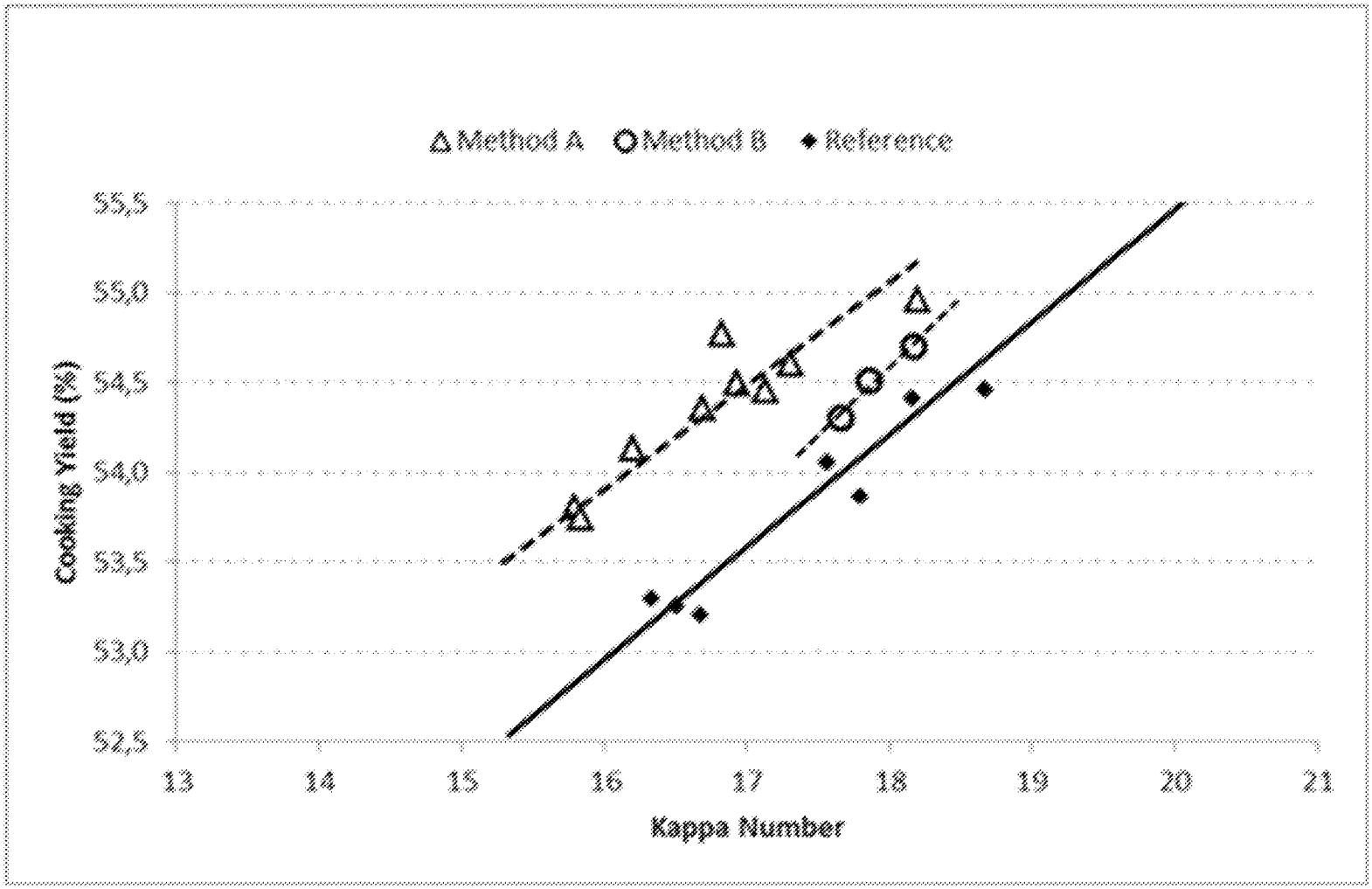
FIG. 5 shows a comparison of cooking screened yield between both described methods A and B for kraft pulp and a reference cooking process over a wide range of kappa numbers in one embodiment.

FIG. 5 shows a comparison of cooking screened yield 501 between implementations of methods A and B for kraft pulp and a reference cooking process over a wide range of kappa numbers 505 in one embodiment.

Table 2 shows the absolute increase in screened cooking yield for implementations of method A over a wide range of retention times and at comparable kappa numbers.

TABLE 2

Method A—Increase in screened cooking yield for different retention times

| Retention time, minutes | Yield increase, %-units |
|---|---|
| 2 | 0.3 |
| 15 | 0.4 |
| 45 | 1.1 |
| 70 | 1.1 |
| 90 | 0.9 |
| 100 | 1.1 |
| 120 | 0.6 |

What is claimed is:

1. A process for increasing the pulp yield in a kraft cooking plant, comprising: utilizing a stream of acidic hydrolysate from an adjacent prehydrolysis kraft process producing dissolving wood pulp, wherein the kraft cooking plant is a parallel cooking plant producing conventional kraft pulp;

wherein the stream of acidic hydrolysate, which contains dissolved hemicelluloses and is produced by prehydrolysis of wood chips in water phase, is reutilized in the kraft cooking plant; and wherein the wood chips in the kraft cooking plant are pretreated and impregnated with the acidic hydrolysate prior to an alkaline cooking process.

2. A process according to claim 1, wherein the acidic impregnation is performed in a vessel preceding an alkaline digester.

3. A process according to claim 1, wherein the acidic impregnation is performed in the alkaline digester.

4. A process according to claim 1, wherein the chips are impregnated with the acidic hydrolysate for a duration of between 2 to 180 minutes.

5. A process according to claim 1, wherein the chips are impregnated with the acidic hydrolysate at a temperature of between 70 to 125° C.

6. The process according to claim 5, wherein the chips are impregnated with the acidic hydrolysate at a temperature of between 90 to 100° C.

7. A process according to claim 1, wherein the acidic hydrolysate is injected in the digester in a cooking zone.

8. A process according to claim 7, wherein the acidic hydrolysate is injected in the last of a plurality of cooking zones.

9. A process according to claim 7, wherein the cooking zone has a residual effective alkali concentration of 10 g/l or less.

10. A process according to claim 7, wherein the cooking zone has a chip retention time of 30 to 90 minutes.

11. A method for producing kraft pulp, comprising:

extracting an acidic hydrolysate from a prehydrolysis kraft process producing dissolving wood pulp, wherein the acidic hydrolysate is produced by prehydrolysis of wood chips in a water phase;

applying the acidic hydrolysate to a parallel kraft cooking process in a kraft cooking plant for producing conventional kraft pulp, including performing an acidic impregnation of wood chips in the kraft cooking plant with the acidic hydrolysate prior to an alkaline cooking process.

12. The method of claim 11, wherein the acidic impregnation of the wood chips is performed in a vessel preceding an alkaline digester.

13. The method of claim 11, wherein the acidic impregnation of the wood chips is performed in an alkaline digester.

14. The method of claim 13, wherein the acidic impregnation is performed in an acidic impregnation zone near a top portion of the alkaline digester.

15. The method according to claim 11, wherein the acidic impregnation is performed for a duration of between 2 to 180 minutes.

16. The method of claim 11, wherein the acidic impregnation is performed at a temperature of between 70 to 125° C.

17. The method of claim 16, wherein the acidic impregnation is performed at a temperature of between 90 to 100° C.

18. The method of claim 11, wherein applying the acidic hydrolysate to the parallel kraft cooking process further comprises:

injecting the acidic hydrolysate in a cooking zone of an alkaline digester.

19. The method of claim 18, wherein the acidic hydrolysate is injected in the last of a plurality of cooking zones of the alkaline digester.

20. The method of claim 18, wherein the cooking zone has a residual effective alkaline concentration of 10 g/l or less.

21. The method of claim 18, wherein the cooking zone has a chip retention time of 30 to 90 minutes.

* * * * *